US005327090A

United States Patent [19]

Shimasaki et al.

[11] Patent Number: 5,327,090

[45] Date of Patent: Jul. 5, 1994

[54] MISFIRE-DETECTING SYSTEM FOR AN INTERNAL COMBUSTION ENGINE WHICH DETECTS A MISFIRE DUE TO THE FUEL SUPPLY SYSTEM

[75] Inventors: Yuuichi Shimasaki; Masaki Kanehiro; Takuji Ishioka; Takashi Hisaki; Shigeru Maruyama; Shigetaka Kuroda; Masataka Chikamatsu; Hideaki Arai, all of Wako, Japan

[73] Assignee: Honda Giken Kogyo Kabushiki Kaisha, Tokyo, Japan

[21] Appl. No.: 93,036

[22] Filed: Jul. 19, 1993

Related U.S. Application Data

[63] Continuation of Ser. No. 846,632, Mar. 5, 1992, abandoned.

[30] Foreign Application Priority Data

Mar. 7, 1991 [JP] Japan ..... 3-067937
Nov. 14, 1991 [JP] Japan ..... 3-326506

[51] Int. Cl.[5] ..... F02P 17/00

[52] U.S. Cl. ..... 324/378; 324/388; 324/399; 123/644

[58] Field of Search ..... 324/378, 388, 399, 402; 123/438, 644; 73/116, 117.3; 361/253

[56] References Cited

U.S. PATENT DOCUMENTS

| | | | |
|---|---|---|---|
| 3,942,102 | 3/1976 | Kuhn | 324/399 |
| 3,961,240 | 6/1976 | Pohl | 324/399 |
| 4,117,807 | 10/1978 | Barnard | 123/478 |
| 4,327,310 | 4/1982 | Jorg | 361/253 |
| 4,366,794 | 1/1983 | Hachiga et al. | 123/479 |
| 4,454,560 | 6/1984 | Nakao et al. | 361/257 |
| 4,684,896 | 8/1987 | Weishaupt | 324/399 |
| 4,825,167 | 4/1989 | Bayba | 324/399 |
| 4,886,029 | 12/1989 | Lill et al. | 324/380 |
| 4,918,389 | 4/1990 | Schleupen et al. | 324/399 |
| 4,969,443 | 11/1990 | DeBiasi | 123/481 |
| 5,017,874 | 5/1991 | Dinunzio et al. | 324/378 |
| 5,019,779 | 5/1991 | Ookawa | 324/388 |
| 5,046,470 | 9/1991 | Entenmann et al. | 324/399 |
| 5,178,001 | 1/1993 | Ikeuchi et al. | 73/117.3 |
| 5,221,904 | 6/1993 | Shimasaki et al. | 324/378 |
| 5,237,279 | 8/1993 | Shimasaki et al. | 324/391 |

FOREIGN PATENT DOCUMENTS 51-22568 7/1976 Japan .

*Primary Examiner*—Kenneth A. Wieder
*Assistant Examiner*—Christopher M. Tobin
*Attorney, Agent, or Firm*—Nikaido, Marmelstein, Murray & Oram

[57] ABSTRACT

A misfire-detecting system for an internal combustion engine detects a value of the sparking voltage generated by the igniting device after generation of the ignition command signal, determines the duration of a discharge of a spark plug, based upon the detected sparking voltage, and determines whether or not a misfire has occurred in the engine, based upon the determined duration of the discharge. For example, the misfire-detecting system measures the duration of the discharge from the time of generation of the ignition command signal, based upon the detected sparking voltage, compares the measured duration of the discharge with a predetermined time period. When the measured duration is shorter than the predetermined time period, it is determined that a misfire has occurred in the engine.

12 Claims, 11 Drawing Sheets

MISFIRE-DETECTING SYSTEM FOR AN INTERNAL COMBUSTION ENGINE WHICH DETECTS A MISFIRE DUE TO THE FUEL SUPPLY SYSTEM

This application is a continuation of U.S. application Ser. No. 07/846,632, filed Mar. 5, 1992, now abandoned.

BACKGROUND OF THE INVENTION

1. Field of the Invention

This invention relates to a misfire-detecting system for internal combustion engines, and more particularly to a misfire-detecting system which is capable of detecting a misfire attributable to the fuel supply system.

2. Prior Art

In an internal combustion engine in general, high voltage (sparking voltage) generated by the ignition coil of the engine is sequentially distributed to the spark plugs of the cylinders of the engine via a distributor, to ignite a mixture supplied to the combustion chambers. If normal ignition does not take place at one or more of the spark plugs, i.e. a misfire occurs, it will result in various inconveniences such as degraded driveability and increased fuel consumption. Furthermore, it can also result in so-called after-burning of unburnt fuel gas in the exhaust system of the engine, causing an increase in the temperature of a catalyst of an exhaust gas-purifying device arranged in the exhaust system. Therefore, it is essential to prevent occurrence of a misfire. Misfires are largely classified into ones attributable to the fuel supply system and ones attributable to the ignition system. Misfires attributable to the fuel supply system are caused by the supply of a lean mixture or a rich mixture to the engine, while misfires attributable to the ignition system are caused by failure to spark (so-called misfiring), i.e. normal spark discharge does not take place at the spark plug.

A conventional misfire-detecting system is already known from Japanese Patent Publication (Kokoku) No. 51-22568, which utilizes the fact that the frequency of damping oscillation voltage generated in a primary circuit of an ignition device whenever the contacts of the distributor are opened is higher when a spark ignition occurs than when failure to spark occurs.

However, the conventional misfire-detecting system is only based upon the frequency of damping oscillation voltage generated in the ignition circuit, i.e. based upon whether or not a discharge occurs between the electrodes of the spark plug. Therefore, the conventional system is unable to discriminate whether a misfire detected is attributable to a cause in the fuel supply system such that although a discharge has actually occurred, the mixture is not fired due to its lean or rich state, or to a cause in the ignition system, thus failing to take a satisfactory and prompt fail-safe action.

SUMMARY OF THE INVENTION

It is the object of the invention to provide a misfire-detecting system for internal combustion engines, which is capable of accurately detecting a misfire attributable to the fuel supply system.

To attain the above object, the present invention provides a misfire-detecting system for detecting a misfire occurring in an internal combustion engine having an ignition system including at least one spark plug, engine operating condition-detecting device for detecting values of operating parameters of the engine, signal-generating device for determining ignition timing of the engine, based upon the detected values of the operating parameters of the engine and for generating an ignition command signal indicative of the determined ignition timing, and igniting device responsive to the ignition command signal for generating sparking voltage for discharging the at least one spark plug.

The misfire-detecting system according to the invention comprises:

voltage value-detecting device for detecting a value of the sparking voltage generated by the igniting device after generation of the ignition command signal; and misfire-determining device for determining a duration of a discharge of the at least one spark plug, based upon an output from the voltage value-detecting device, and for determining whether or not a misfire has occurred in the engine, based upon the determined duration of the discharge.

In a preferred embodiment of the invention, the misfire-determining device includes a measuring device for measuring the duration of the discharge from the time of generation of the ignition command signal, based upon the output from the voltage value-detecting device, and a comparator device for comparing the measured duration of the discharge with a predetermined time period.

The misfire-determining device determines that a misfire has occurred in the engine, when the measured duration of the discharge is shorter than the predetermined time period, as a result of the comparison by the comparator device.

Preferably, the measuring device determines a reference voltage value, based upon the output from the voltage value-detecting device, measures a time period during which the sparking voltage subsequently detected by the voltage value-detecting device is continuously greater than the determined reference voltage value, and adopts the measured time period as the duration of the discharge.

Also preferably, the measuring device determines the reference voltage value, based upon a peak value of the discharge voltage detected by the voltage value-detecting device.

Alternatively, the measuring device may determine the reference voltage value, based upon an integrated value of the discharge voltage detected by the voltage value-detecting device.

In another embodiment of the invention, the misfire-determining device includes first comparator operable immediately after generation of the ignition command signal, for comparing the sparking voltage detected by the voltage value-detecting device with a first predetermined voltage value, second comparator operable when the sparking voltage exceeds the first predetermined voltage value, for comparing the sparking voltage subsequently detected by the voltage value-detecting device with a second predetermined voltage value until a predetermined time period elapses after generation of the ignition command signal, and determining device for determining that a misfire has occurred in the engine, when the sparking voltage is below the second predetermined voltage value.

The predetermined time period is set to a first time period slightly longer than a second time period from the time of generation of the ignition command signal to the time of occurrence of a capacitive discharge following an inductive discharge. The second time period is assumed when a normal firing occurs.

Preferably, the first and second predetermined voltage values are set in dependence on operating conditions of the engine.

The ignition coil comprises a primary coil and a secondary coil. The sparking voltage may be either primary voltage generated by the primary coil, or secondary voltage generated by the secondary coil.

The above and other objects, features, and advantage of the invention will become more apparent from the following detailed description taken in conjunction with the accompanying drawings.

DETAILED DESCRIPTION

The invention will now be described in detail with reference to the drawings showing an embodiment thereof.

Figure 1:
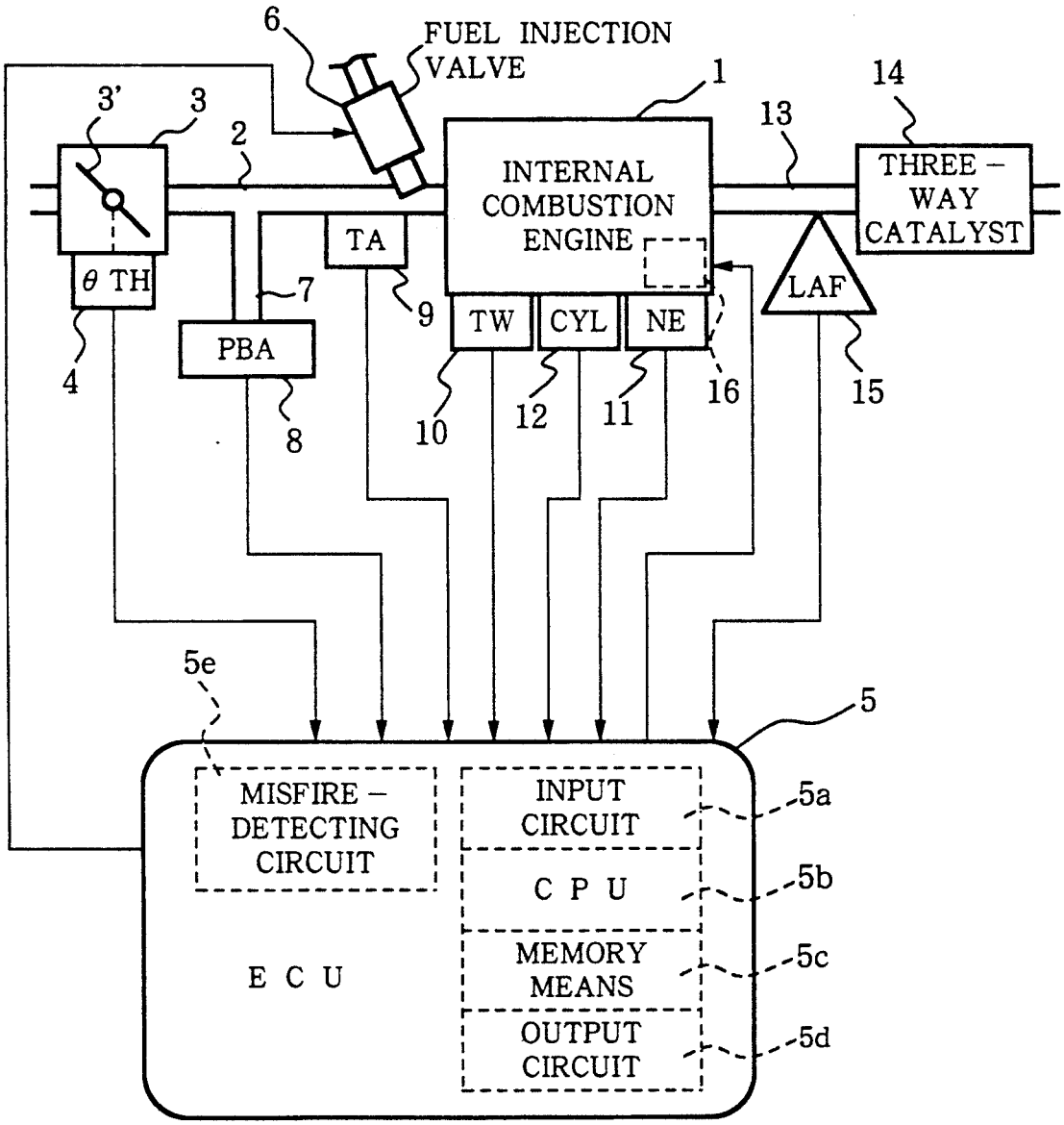
FIG. 1 is a block diagram showing the whole arrangement of an internal combustion engine incorporating a misfire-detecting system according to the invention.

Referring first to FIG. 1, there is shown the whole arrangement of an internal combustion engine incorporating a misfire-detecting system according to the invention. In an intake pipe 2 of an engine 1, there is arranged a throttle body 3 accommodating a throttle valve 3' therein. A throttle valve opening ($\theta$TH) sensor 4 is connected to the throttle valve 3' for generating an electric signal indicative of the sensed throttle valve opening and supplying the same to an electronic control unit (hereinafter referred to as "the ECU") 5.

Fuel injection valves 6 are each provided for each cylinder and arranged in the intake pipe at a location between the engine 1 and the throttle valve 3' and slightly upstream of an intake valve, not shown. The fuel injection valves 6 are connected to a fuel pump, not shown, and electrically connected to the ECU 5 to have their valve opening periods controlled by signals therefrom.

On the other hand, an intake pipe absolute pressure (PBA) sensor 8 is provided in communication with the interior of the intake pipe 2 via a conduit 7 at a location immediately downstream of the throttle valve 3' for supplying an electric signal indicative of the sensed absolute pressure to the ECU 5. An intake air temperature (TA) sensor 9 is inserted into the intake pipe 2 at a location downstream of the intake pipe absolute pressure sensor 8 for supplying an electric signal indicative of the sensed intake air temperature TA to the ECU 5.

An engine coolant temperature (TW) sensor 10, which may be formed of a thermistor or the like, is mounted in the cylinder block of the engine 1 for supplying an electric signal indicative of the sensed engine coolant temperature TW to the ECU 5. An engine rotational speed (NE) sensor 11 and a cylinder-discriminating (CYL) sensor 12 are arranged in facing relation to a camshaft or a crankshaft of the engine 1, neither of which is shown. The engine rotational speed sensor 11 generates a pulse as a TDC signal pulse at each of predetermined crank angles whenever the crankshaft rotates through 180 degrees, while the cylinder-discriminating sensor 12 generates a pulse at a predetermined crank angle of a particular cylinder of the engine, both of the pulses being supplied to the ECU 5.

A three-way catalyst 14 is arranged within an exhaust pipe 13 connected to the cylinder block of the engine 1 for purifying noxious components such as HC, CO and $NO_X$. An $O_2$ sensor 15 as an exhaust gas ingredient concentration sensor (referred to hereinafter as an "LAF sensor") is mounted in the exhaust pipe 13 at a location upstream of the three-way catalyst 14, for supplying an electric signal having a level approximately proportional to the oxygen concentration in the exhaust gases to the 1CU 5.

Further, an ignition device 16, which comprises an ignition coil, and spark plugs, hereinafter referred to, is provided in the engine 1 and controlled to effect spark ignition by an ignition command signal A from the ECU 5.

The ECU 5 comprises an input circuit **5*a* having the functions of shaping the waveforms of input signals from various sensors as mentioned above, shifting the voltage levels of sensor output signals to a predetermined level, converting analog signals from analog-output sensors to digital signals, and so forth, a central processing unit (hereinafter referred to as "the CPU") 5*b*, memory means 5*c* storing various operational programs which are executed by the CPU 5*b* and for storing results of calculations therefrom, etc., an output circuit 5*d* which outputs driving signals and the ignition command signal A to the fuel injection valves 6 and the ignition device 16, respectively, and a misfire-detecting circuit 5*e***, hereinafter described.

The CPU **5*b* operates in response to the above-mentioned signals from the sensors to determine operating conditions in which the engine 1 is operating such as an air-fuel ratio feedback control region and open-loop control regions, and calculates, based upon the determined engine operating conditions, the valve opening period or fuel injection period $T_{OUT}$ over which the fuel injection valves 6 are to be opened in synchronism with inputting of TDC signal pulses to the ECU 5**.

Further, the CPU5*b* calculates the ignition timing TIG of the engine, based upon the determined engine operating condition.

The CPU 5*b* performs calculations as described hereinbefore, and supplies the fuel injection valves 6 and the ignition device 16, respectively, with driving signals and the ignition command signal A based on the calculation results through the output circuit 5*d*.

Figure 2:
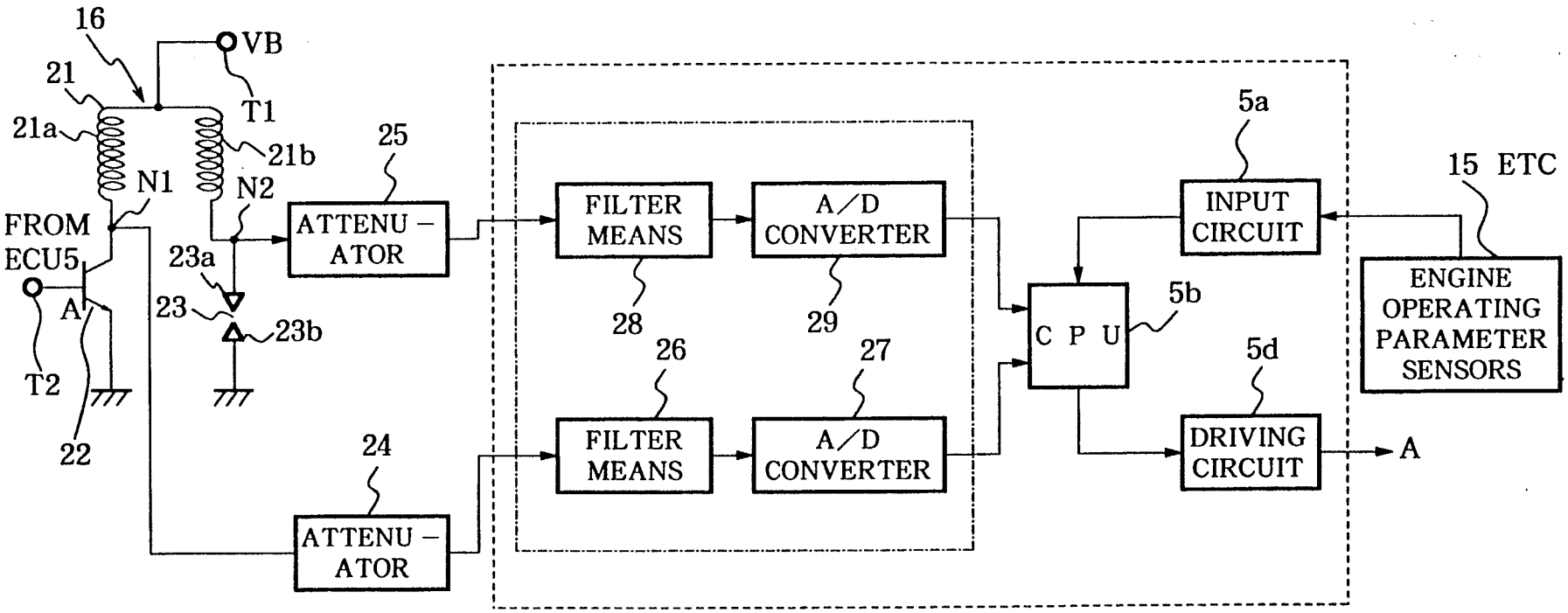
FIG. 2 is a block diagram showing a misfire-detecting system for an internal combustion engine according to an embodiment of the invention.

FIG. 2 shows the arrangement of the misfire-detecting system according to an embodiment of the invention. The misfire-detecting system according to this embodiment is adapted to detect whether or not a misfire has occurred and also whether or not the misfire is attributable to the fuel supply system, from the magnitude of capacitive discharge voltage generated by discharging of the spark plug.

In FIG. 2, the ignition device 16 is constructed such that a feeding terminal T1, which is supplied with supply voltage VB, is connected to an ignition coil (igniting means) 21 comprised of a primary coil 21*a* and a secondary coil 21*b*. The primary and secondary coils 21*a*, 21*b* are connected with each other at one end thereof. The other end of the primary coil 2 is connected to a collector of a transistor 22 by way of a node N1 at which sparking voltage (primary voltage) is generated. The transistor 22 has its base connected to an input terminal T2 which is supplied with the ignition command signal A and its emitter grounded. The other end of the secondary coil 21*b* is connected to a center electrode 23*a* of a spark plug 23 of each engine cylinder by way of a node N2 at which sparking voltage (secondary voltage) is generated. The spark plug 23 has its ground electrode 23*b* grounded. The node N1 is connected to an input of an attenuator (voltage value-detecting means) 24, while the node N2 is connected to an input of another attenuator (voltage value-detecting means) 25. The attenuators 24, 25 have their outputs connected to processing unit the CPU 5*b* by way of filter means 26, 28 and A/D convertors 27, 29 of the ECU 5. The attenuators 24, 25 are voltage-dividing means which divide the primary and secondary voltages with respective predetermined ratios of 1/1000 and 1/100, respectively, so that the primary voltage is changed from several hundreds volts to several volts, and the secondary voltage from several tens kilovolts to several tens volts. The CPU 5*b* is connected to the base of the transistor 22 by way of the output circuit 5*d*, which is supplied with the ignition command signal A, and also connected via the input circuit 5*a* to various engine operating parameter sensors (engine operating condition-detecting means) including the NE sensor 15 and the PBA sensor 8. The CPU 5*b* forms a) the signal-generating means which determines the ignition timing based upon engine operating conditions and generates the ignition command signal A, and b) the misfire-determining means which determines whether or not a misfire attributable to the fuel supply system has occurred.

Figure 4:
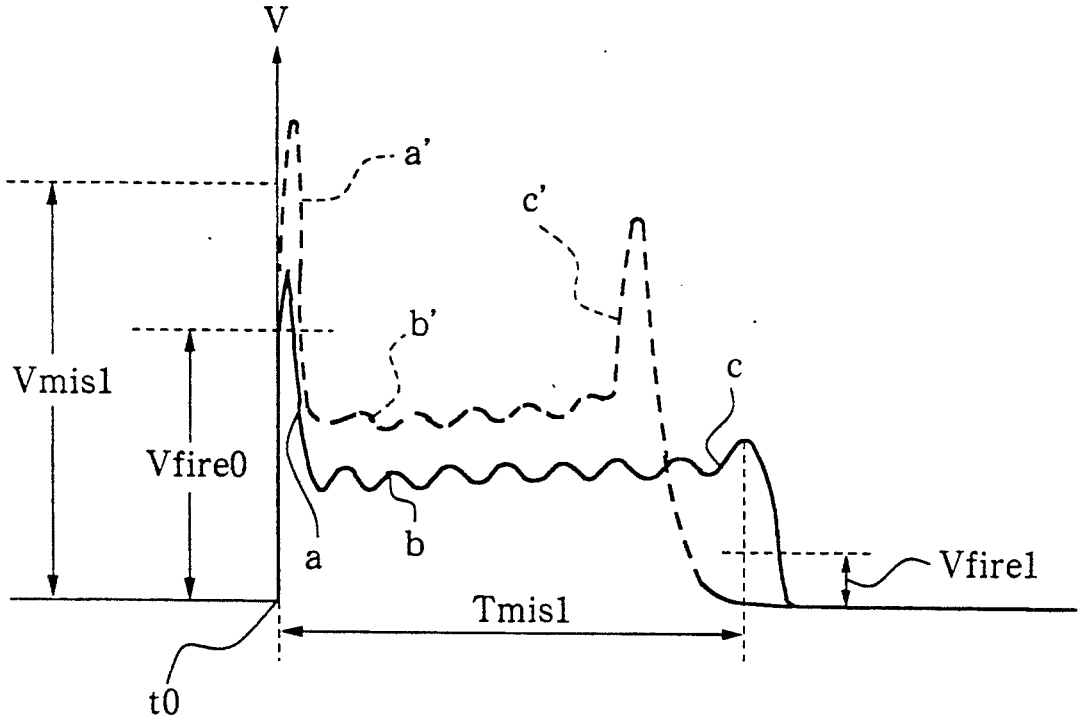
FIG. 4 is a timing chart showing changes in the primary voltage, useful in explaining misfires attributable to the fuel supply system.
Figure 6:
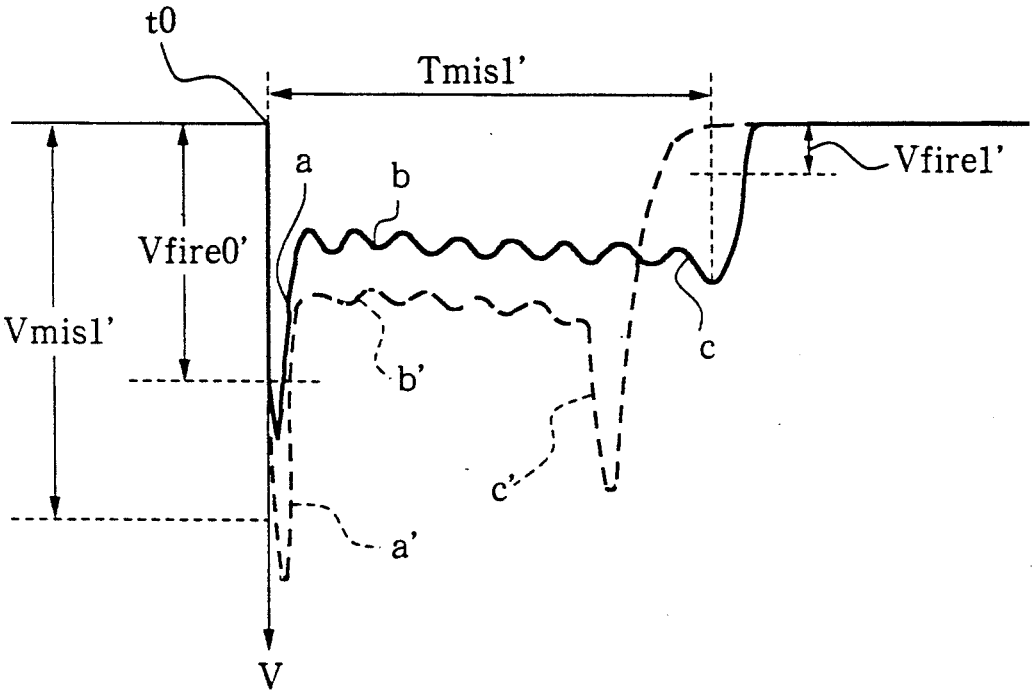
FIG. 6 is a timing chart showing changes in the secondary voltage, useful in explaining misfires attributable to the fuel supply system.

FIGS. 4 and 6 are timing charts showing, respectively, sparking voltage (primary voltage) generated by the primary coil 21*a* of the ignition coil 21, and sparking voltage (secondary voltage) generated by the secondary coil 21*b*, the voltages being generated in response to the ignition command signal A.

These figures are useful in explaining misfires attributable to the fuel supply system. In each of FIGS. 4 and 6, the solid lines indicate a sparking voltage obtained when the mixture is normally fired, and the broken lines a sparking voltage obtained when a misfire occurs.

Sparking voltage characteristics obtainable in the above respective cases will now be explained with reference to FIG. 4.

First, a sparking voltage characteristic obtainable in the case of normal firing will be explained, which is indicated by the solid lines. Suppose that immediately after a time point tO the ignition command signal A is generated. Then, sparking voltage rises to such a level as to cause dielectric breakdown of the mixture between the electrodes of the spark plug, i.e. across the discharging gap of the spark plug (curve a). For example, as shown in FIG. 4, when the sparking voltage has exceeded a reference voltage value Vfire0 for determination of a normal firing, i.e. $V > Vfire0$, dielectric breakdown of the mixture occurs, and then the discharge state shifts from a capacitive discharge state before the dielectric breakdown, which state has a very short duration with several hundreds amperes of current flow, to an inductive discharge state which has a duration of several milliseconds and where the sparking voltage assumes almost a constant value with several tens milliamperes of current flow (curve b). The inductive discharge voltage rises with an increase in the pressure within the engine cylinder caused by the compression stroke of the piston executed after the time point tO, since a higher voltage is required for inductive discharge to occur as the cylinder pressure increases. At the final stage of the inductive discharge, the voltage between the electrodes of the spark plug falls below a value required for the inductive discharge to continue, due to decreased inductive energy of the ignition coil so that the inductive discharge ceases and again capacitive discharge occurs. In this capacitive discharge state, the voltage between the spark plug electrodes again rises, i.e. in the direction of causing dielectric breakdown of the mixture. However, since the ignition coil 21 then has a small amount of residual energy, the amount of rise of the voltage is small (curve c). This is because the electrical resistance of the discharging gap is low due to ionizing of the mixture during firing.

Next, reference is made to a sparking voltage characteristic indicated by the broken lines, which is obtained when a misfire occurs, which is caused by the supply of a lean mixture to the engine or cutting-off of the fuel supply to the engine due to failure of the fuel supply system, etc. Immediately after the time point tO of generation of the ignition command signal A, the sparking voltage rises above a level causing dielectric breakdown of the mixture. In this case, the ratio of air in the mixture is greater than when the mixture has an air-fuel ratio close to a stoichimetric ratio, and accordingly the dielectric strength of the mixture is high. Besides, since the mixture is not fired, it is not ionized so that the electrical resistance of the discharging gap of the plug is high. Consequently, the dielectric breakdown voltage becomes higher than that obtained in the case of normal firing of the mixture (curve a'), as shown in FIG. 4.

Thus, the sparking voltage V exceeds a reference voltage value Vmis1 for determining a misfire attributable to the fuel supply system ($V > Vmis1$). Thereafter, the discharge state shifts to an inductive discharge state, as in the case of normal firing (curve b'). Also, the electrical resistance of the discharging GaP of the plug at the discharge of the ignition coil is Greater in the case of supply of a lean mixture, etc. than that in the case of normal firing so that the inductive discharge voltage rises to a higher level than at normal firing, resulting in an earlier shifting from the inductive discharge state to a capacitive discharge state. The capacitive discharge voltage upon the transition from the inductive discharge state to the capacitive discharge state is by far higher than that at normal firing (curve c'), because the voltage of dielectric breakdown of the mixture is higher than that at normal firing, and also because the ignition coil still has a considerable amount of residual energy due to the earlier termination of the inductive discharge (i.e. the discharge duration is shorter). Consequently, immediately after termination of this capacitive discharge the residual energy of the ignition coil suddenly decreases and accordingly the sparking voltage suddenly drops to nearly zero volts (curve c').

This invention utilizes the fact that in the event of occurrence of a misfire attributable to the fuel supply system (hereinafter called "FI misfire"), the sparking voltage drops to nearly zero volt earlier than in the case of normal firing.

As shown in FIGS. 4 and 6, the sparking voltage (secondary voltage) generated by the secondary coil 21*b* of the ignition coil 21 presents almost identical characteristics with those described above with respect to the sparking voltage (primary voltage) generated by the primary coil 21*a* of the ignition coil 21. Therefore, description of the secondary voltage characteristics is omitted.

Figure 3:
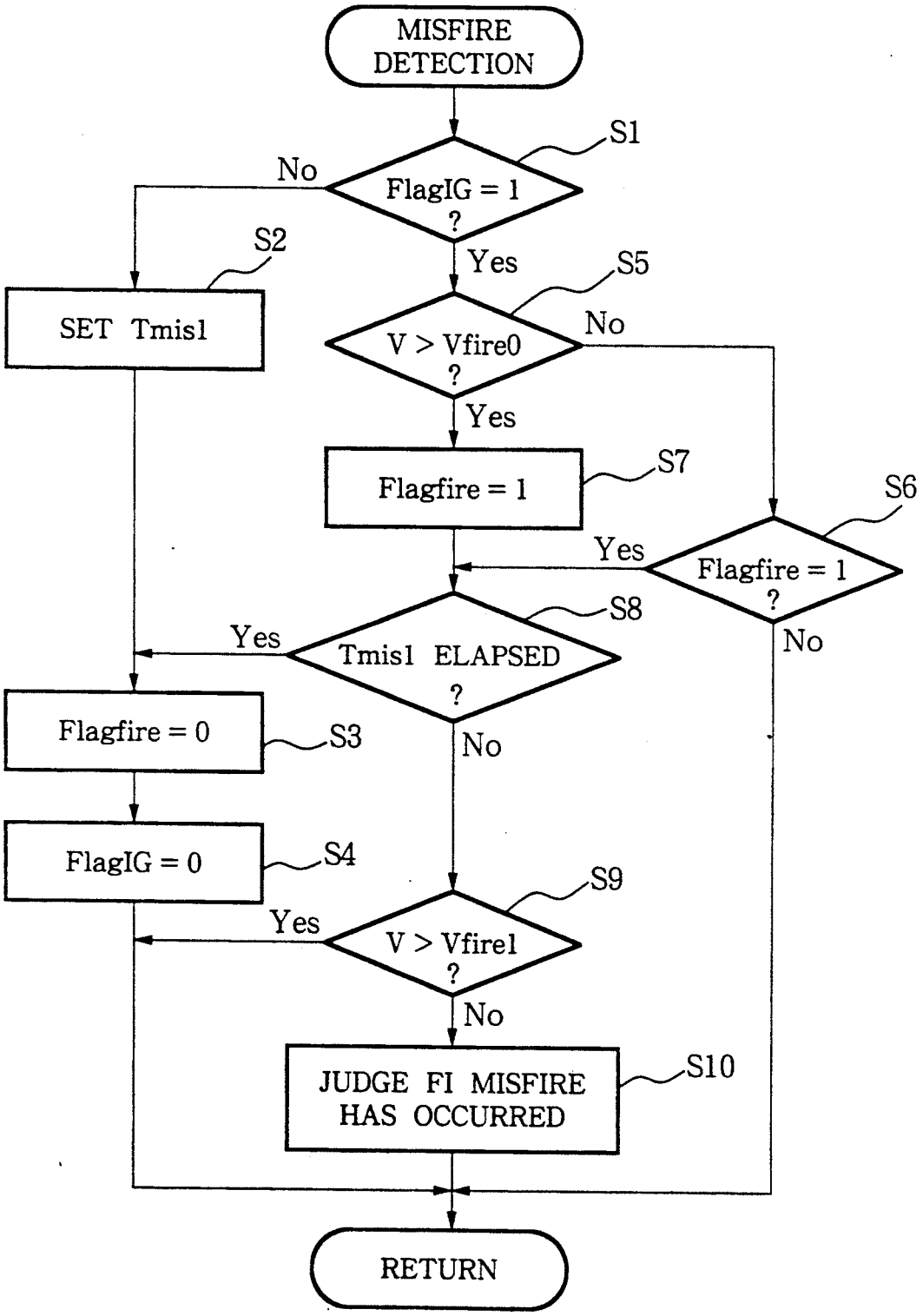
FIG. 3 is a flowchart showing a program for detecting a misfire attributable to the fuel supply system, based upon the primary voltage (sparking voltage) of an ignition coil in FIG. 1.

Next, the operation of the misfire-detecting circuit of FIG. 2 based upon the primary voltage of the ignition coil 21 will be explained with reference to FIGS. 3 and 4. FIG. 3 shows a program for detecting a misfire attributable to the fuel supply system by means of the FIG. 2 circuit. This program is executed at predetermined fixed time intervals.

First, it is determined at a step S1 whether or not a flag IG, which is indicative of whether or not the ignition command signal A has been Generated, has been set to a value of 1. The flag IG indicates, when set to 1, that the signal A has been Generated. The flag IG is thus set to 1 upon generation of the signal A and then again reset to 0 upon the lapse of a predetermined time period thereafter, by a routine other than the FIG. 3 routine, e.g. an ignition timing-calculating routine. When the ignition command signal A has not been generated, the answer to the question of the step S1 is negative (No), and then the program proceeds to steps S2, S3 and S4, where a timer within the ECU5, which measures time elapsed after generation of the ignition command signal A, is set to a predetermined time period Tmis1 and started, and a flag FIRE and the flag IG are both set to 0, followed by terminating the program. The predetermined time period Tmis1 is set at a time period slightly longer than a time period from the time of generation of the ignition command signal A to the time of occurrence of capacitive discharge following the inductive discharge, assumed when a normal firing occurs, and is read from a map or a table in accordance with operating conditions (operating parameter values) of the engine 1.

When the ignition command signal A has been generated and hence the flag IG has been set to 1, the program proceeds from the step S1 to a step S5 to determine whether or not the sparking voltage V has exceeded the reference voltage value (first predetermined voltage value) Vfire0 (see FIG. 4). The reference voltage value Vfire0 is read from a map or a table in accordance with engine operating conditions, e.g. engine rotational speed, engine load, battery voltage, and engine temperature. Another reference voltage value Vfire1, referred to hereinafter, is also read from a map or a table in accordance with engine operating conditions. When $V \leqq$ Vfire0 holds at the step S5, the program proceeds to a step S6 where it is determined whether or not the flag FIRE assumes a value of 1. If the flag FIRE does not assume 1, it is immediately followed by terminating the program. If the flag FIRE=1, the program precedes to a step S8, hereinafter referred to. If $V >$ Vfire0 holds at the step S5, the program proceeds to a step S7 where the flag FIRE is set to 1, and then the program proceeds to the step S8 to determine whether or not the predetermined time period Tmis1 has elapsed from the time of generation of the ignition command signal A (FIG. 4). If the predetermined time period Tmis1 has elapsed, it is determined that it is no longer necessary to effect the FI misfire detection, followed by executing the steps S3 and S4 and terminating the program. If the predetermined time period Tmis1 has not yet elapsed at the step S8, it is determined at a step S9 whether or not the sparking voltage V is lower than the reference voltage (second predetermined voltage value) Vfire1. The reference voltage Vfire1 is set at a value much higher than zero volts but much lower than a value of inductive discharge voltage assumed at normal firing. If $V \leqq$ Vfire1 at the step S9, it is determined at a step S10 that an FI misfire has occurred; whereas if $V >$ Vfire1, it is determined that no FI misfire has occurred.

Figure 5:
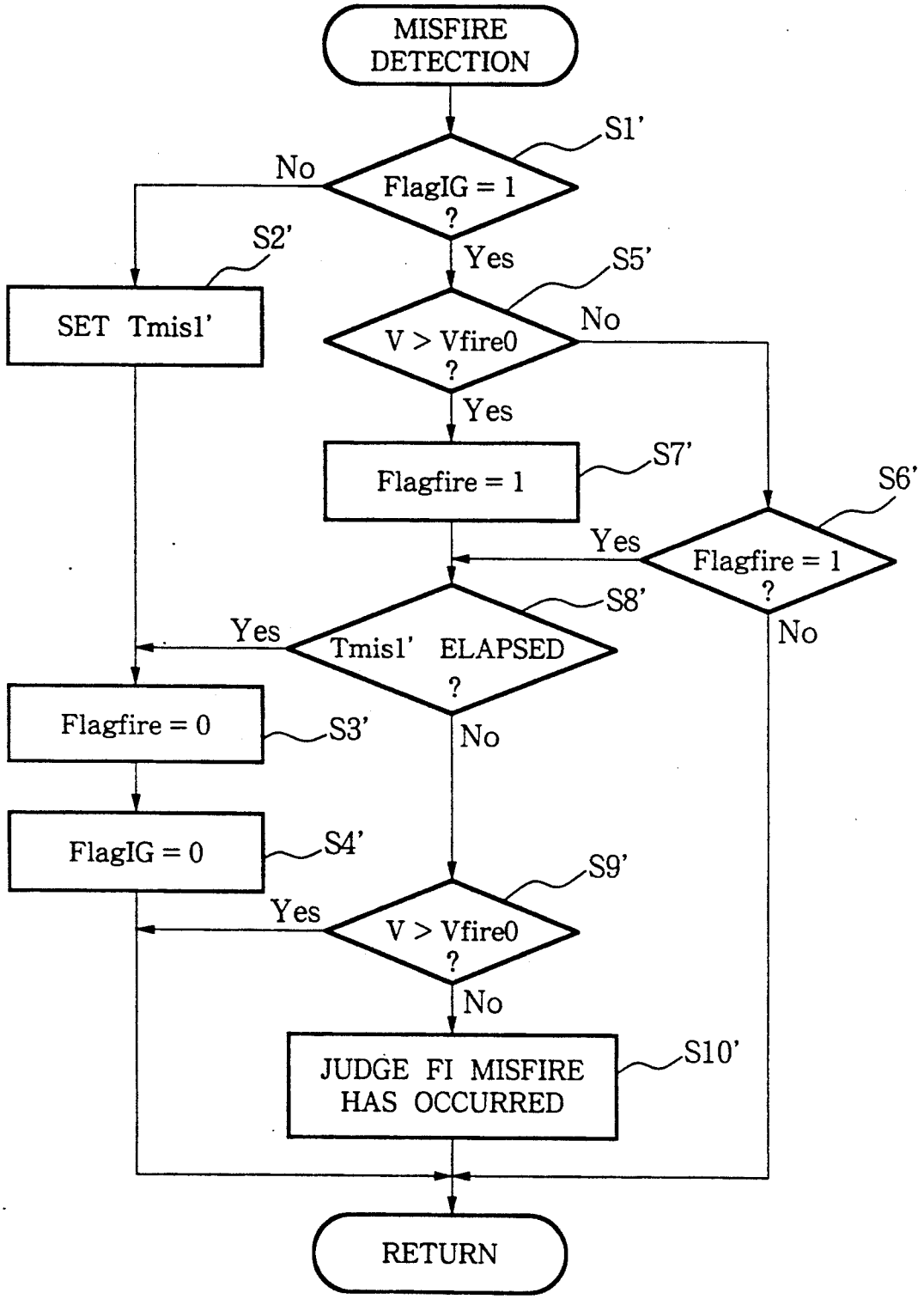
FIG. 5 is a flowchart showing a program for detecting a misfire attributable to the fuel supply system, based upon the secondary voltage (sparking voltage) of ignition coil.

Next, reference is made to FIGS. 5 and 6 showing a manner of detecting an FI misfire according to a second embodiment of the invention, which detects an FI misfire based upon the secondary voltage of the ignition coil, by means of a misfire-detecting system according to the invention. In FIGS. 5 and 6, a predetermined time period Tmis1', and reference voltage values Vfire0', Vfire1', and Vmis1' correspond, respectively, to Tmis1, and Vfire0, Vfire1, and Vmis1 in FIGS. 3 and 4. The operation shown in FIG. 5 is the same with the operation shown in FIG. 3 described above, and therefore description thereof is omitted. The values Vfire0 and Vfire0' may be either equal to each other or different from each other, though the reference voltage value Vfire0 is usually set to a smaller value than Vfire0'.

It will be understood from the above given description that actually the programs of FIGS. 3 and 5 determine whether the sparking voltage V drops below the reference voltage value (second predetermined value) Vfire1 (or Vfire1') (FIG. 4 and 6) after the sparking voltage V has exceeded the reference voltage value (first predetermined value) Vfire0 (or Vfire0') but before the lapse of the predetermined time period Tmis1 (or Tmis1') after generation of the ignition command signal A, and determine that normal firing has occurred if the sparking voltage V has dropped below the second predetermined value Vfire1 (Vfire1').

In the above described manner, according to the invention, the kind of a misfire, i.e. the occurrence of an FI misfire can be accurately determined, thereby making it possible to determine the faulty place at an early time and take an appropriate fail-safe action.

Figure 7:
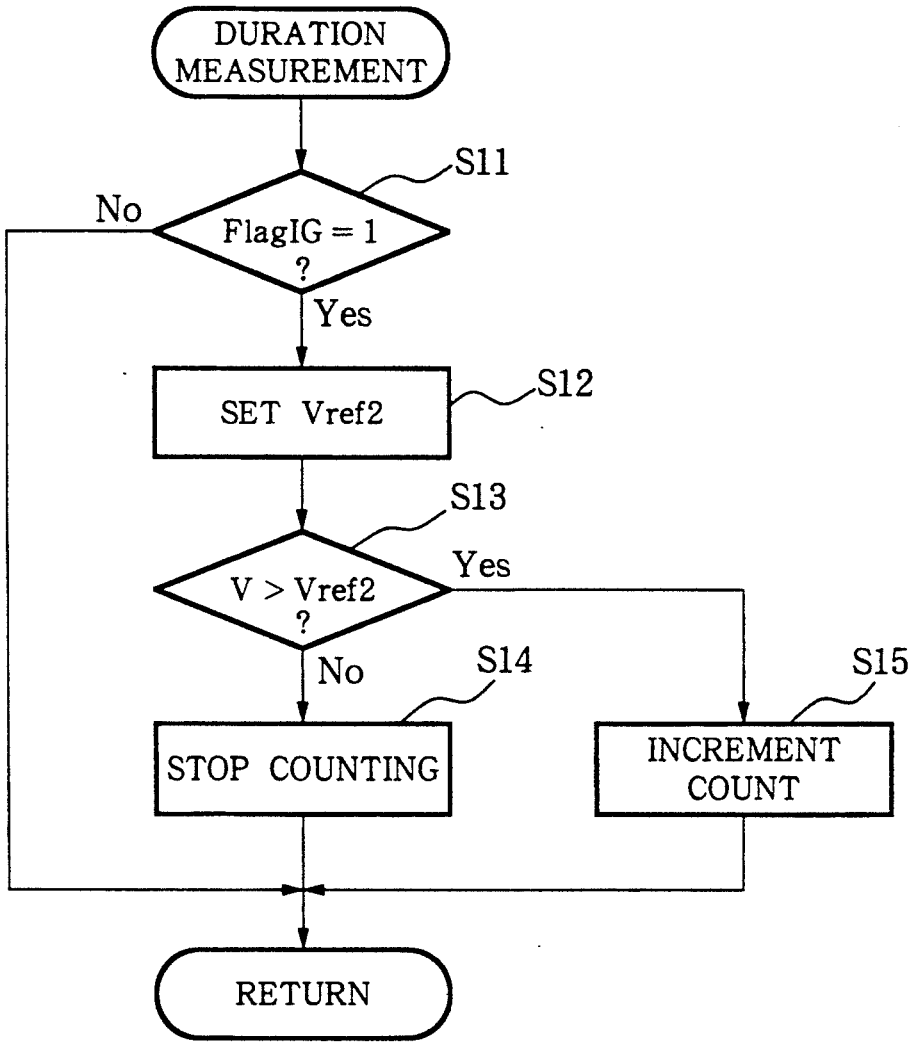
FIG. 7 is a flowchart showing a program for measuring a discharge duration for use in a manner of misfire detection according to a second embodiment of the invention.
Figure 8:
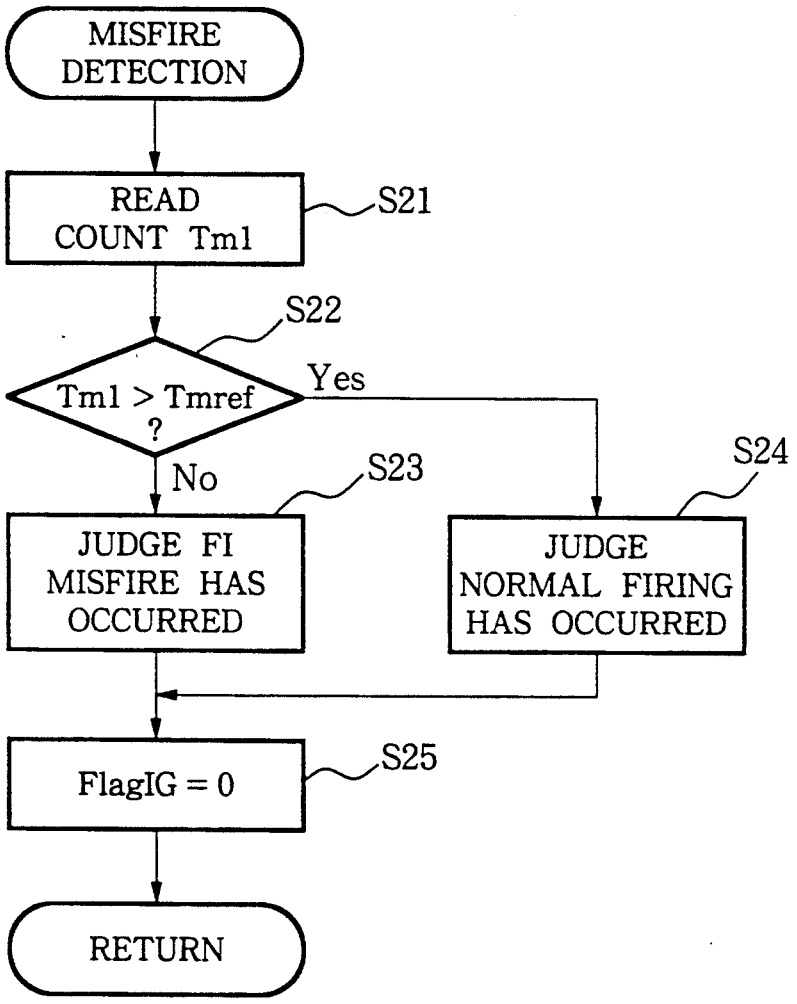
FIG. 8 is a flowchart showing a program for detecting a misfire attributable to the fuel supply system, based upon the discharge duration obtained by the program of FIG. 7.

FIGS. 7 and 8 show programs for detecting an FI misfire according to a third embodiment of the invention. The program of FIG. 7 is executed at predetermined fixed time intervals, while the program of FIG. 8 is executed after a predetermined time period elapsed from the time of generation of the ignition command signal A (e.g. after the time point $t_2$ in (a) of FIG. 9 at which the predetermined time period Tmis1 elapses in the first embodiment described before).

At a step S11 in FIG. 7, it is determined whether or not the flag IG assumes 1. If the answer is negative (No), the program is immediately terminated. If the flag IG assumes 1, a peak value of the sparking voltage V is held as it is (Peak Holding), and the held peak value is multiplied by a predetermined value $\alpha$ which is smaller than 1 to calculate a reference voltage $Vref_2$ (step S12). Thus, the reference voltage $Vref_2$ is set to a value dependent upon the held peak value of the sparking voltage V, as shown in (a) of FIG. 9. The held peak value is reset to 0 immediately before the next occurrence of the ignition command signal A (at a time point t1 in (a) of FIG. 9).

At the next step S13, it is determined whether or not the sparking voltage V is higher than the reference voltage $Vref_2$. If $V > Vref_2$, the count of a duration counter, which measures a time period during which $V > Vref_2$ continues to hold, is incremented at a step S15, while if $V \leqq Vref_2$, the duration counter is stopped at a step S14, followed by terminating the program.

Thus, by the program of FIG. 7, a discharge duration Tm1 (at normal firing) or Tm1' (at FI misfire) is measured.

At a step S21 in FIG. 8, the count of the duration counter, i.e. the discharge duration Tm1 is read, and it is determined at a step S22 whether or not the discharge duration Tm1 is longer than a reference value Tmref. If the answer is affirmative (Yes), i.e. $Tm1 \leqq Tmref$, it is determined at a step S23 that an FI misfire has occurred, and then the flag IG is reset to 0 at a step S24, followed by terminating the program.

Figure 9:
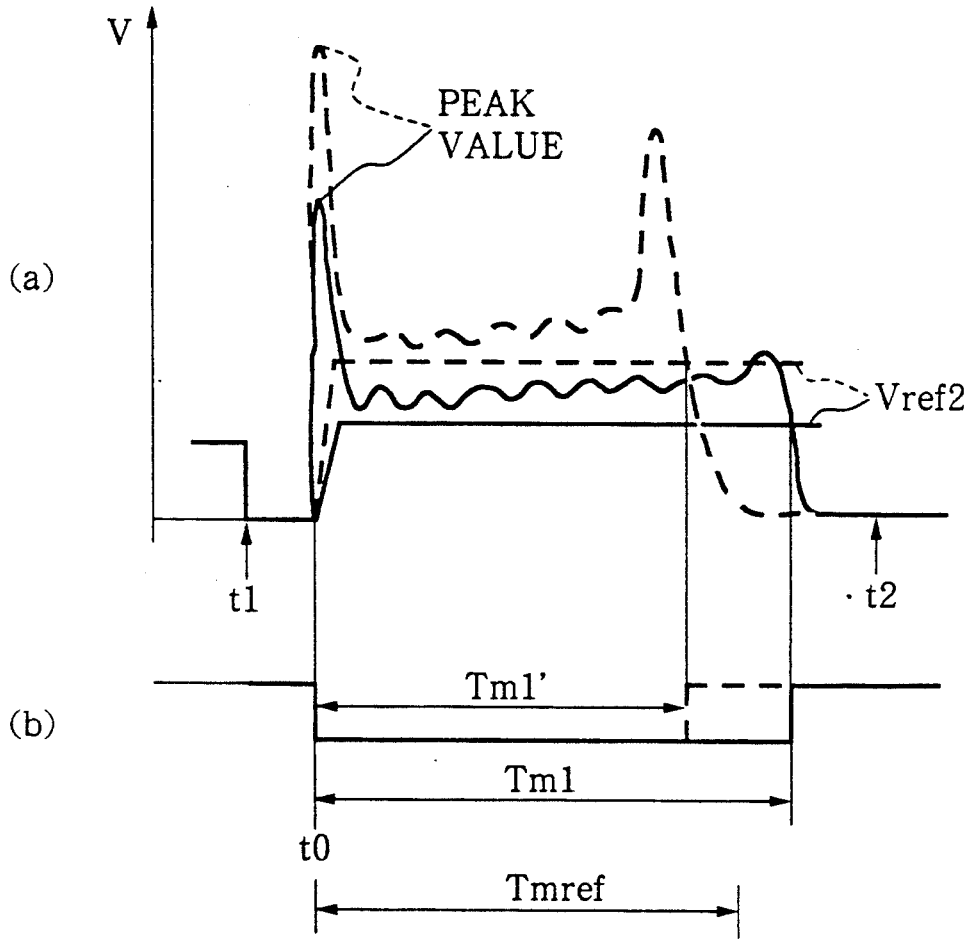
FIG. 9 is a timing chart showing changes in the primary voltage, useful in explaining the operation of the programs of FIGS. 7 and 8.

According to the program of FIG. 8, as shown in (b) of FIG. 9, when an FI misfire occurs, the discharge duration Tm1' becomes shorter than the reference value Tmref, thus making it possible to detect the occurrence of the FI misfire.

In the above described manner, according to this embodiment, the reference voltage $Vref_2$ is set based upon the sparking voltage V. As a result, even when the sparking voltage V varies with a change in the operating condition of the engine, the discharge duration Tm1 can be accurately determined to thereby improve the accuracy of detection of F1 misfire.

The time at which the flag IG is set to 1, i.e. the time point for starting measurement of the discharge duration time period, need not coincide with the time of generation of the ignition command signal A, insofar as the measurement starting time is set at a time close to the time of generation of the signal A.

Figure 10:
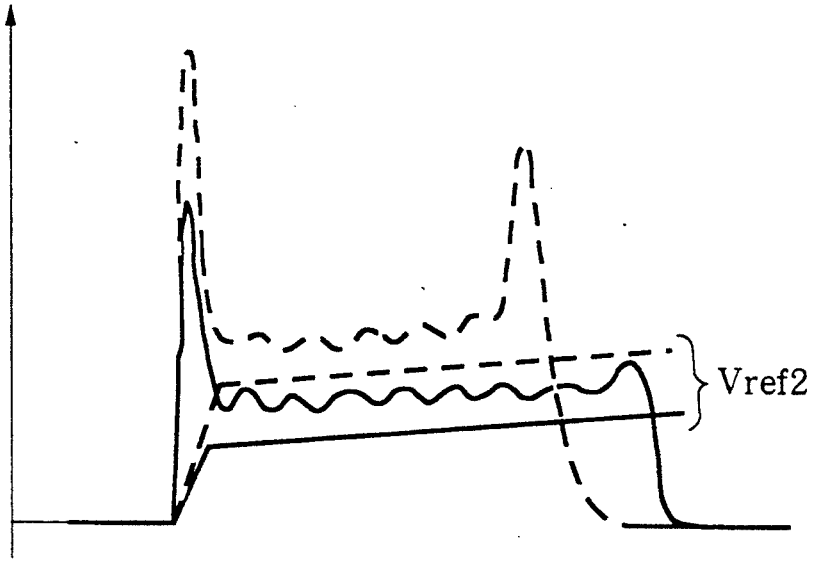
FIG. 10 is a view showing changes in the primary voltage, obtained by integrating the sparking voltage.

Further, although in the above described embodiment the reference voltage $Vref_2$ is set based upon a peak-held value of the sparking voltage V, this is not limitative, but it may be set based upon an integrated value of the sparking voltage V, for instance. In this alternative case, the voltage $Vref_2$ shows a characteristic that it progressively increases with the lapse of time, as shown in FIG. 10, but the discharge duration Tm1 can be determined even with such characteristic, as accurately as in the previous embodiment.

The misfire detecting manner described above with reference to FIGS. 7 and 8 may also be carried out by hardware. FIG. 10 shows the arrangement of a circuit (hardware) which carries out the misfire detecting manner of FIGS. 7 and 8, given by way of example. The output of the filter means 26 in FIG. 2 is connected to the input of a peak-holding (or integrating) circuit 121 as well as to an inverting input terminal of a comparator 124. Connected to the peak-holding circuit 121 is a reset circuit 122 which resets the peak-held value at the time point t1 in (a) of FIG. 9. The peak-holding circuit 121 holds a peak value of input voltage from the filter means 26 and supplies the held peak value to a reference voltage-setting circuit 123, which is formed of a resistance type potential divider which performs the function of multiplying the held peak value by the predetermined value $\alpha$ ($<1$). The output of the circuit 123 is connected to a non-inverting input terminal of the comparator 124.

Thus, the comparator 124 generates an output pulse which goes low when $V > Vref_2$ holds, as shown in (b) of FIG. 9. The output of the comparator 124 is connected to a pulse duration-measurement circuit 125 which measures the pulse width in (b) of FIG. 9, i.e. the discharge duration Tm1 (Tm1'). An output from the measurement circuit 125 indicative of the measured discharge duration Tm1 (Tm1') is supplied to a misfire-determination circuit 126, which in turn generates an output indicative of occurrence of an FI misfire when $Tm1\ (Tm1') < Tmref$ holds.

Figure 11:
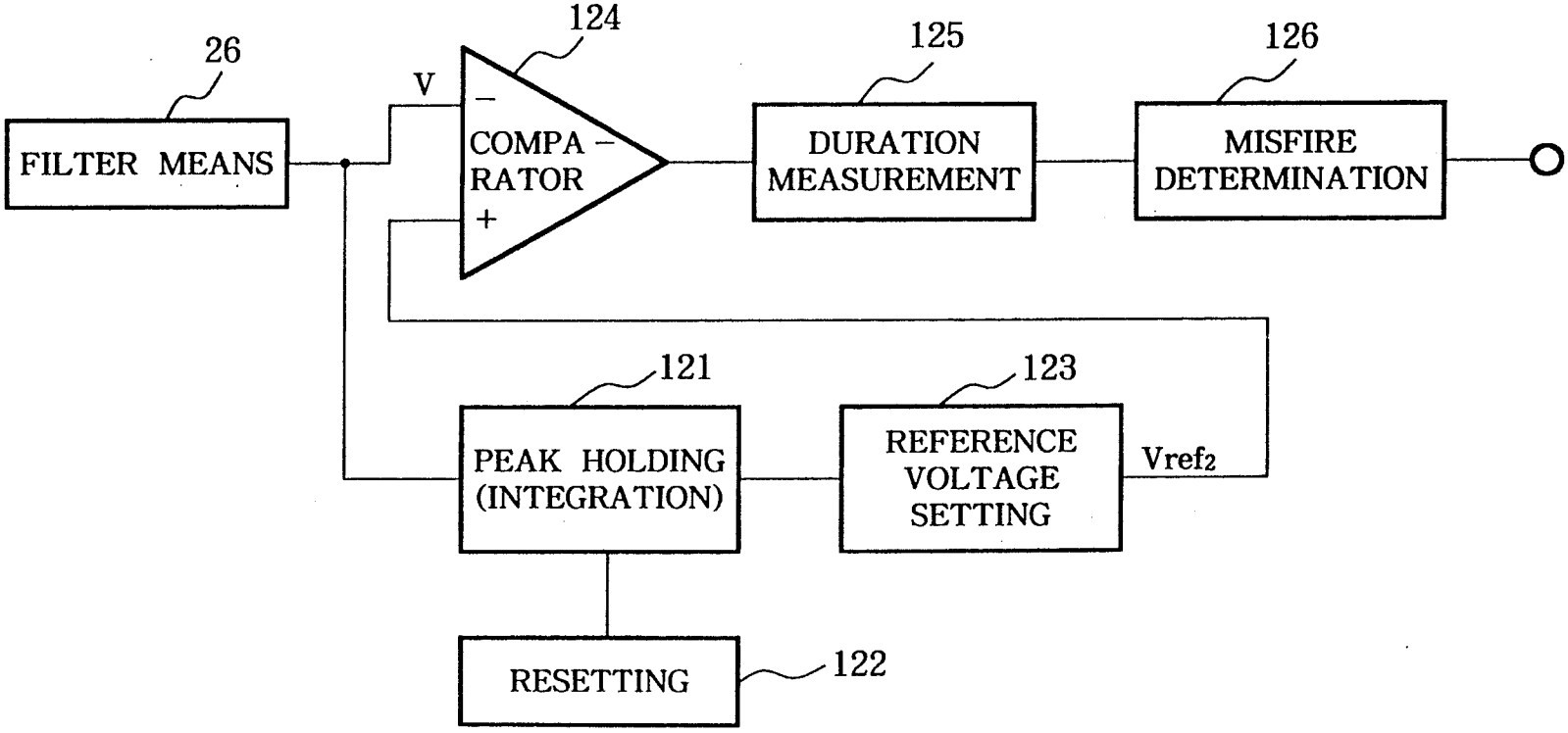
FIG. 11 is a block diagram showing the arrangement of a circuit for carrying out the programs of FIGS. 7 and 8.

In this manner, even with the circuit of FIG. 11, it is possible to detect an FI misfire as accurately as the programs of FIGS. 7 and 8. In the circuit of FIG. 11, the peak-holding circuit 121 may be replaced by an integrating circuit, providing similar results.

Alternatively of using the primary voltage of the ignition coil 21 as in the third embodiment described above, it goes without saying that the second voltage may be used instead of the primary voltage.

As described above, according to the invention, the duration of a discharge occurring at the spark plug is measured based upon an output of the voltage value-detecting means, and whether or not a misfire has occurred is determined from the measured discharge duration. Therefore, the occurrence of a misfire can be detected with accuracy, enabling to detect the faulty place at an early time and take an appropriate fail-safe action.

What is claimed is:

1. A misfire-detecting system for detecting a misfire occurring in an internal combustion engine having an ignition system including at least one spark plug, engine operating condition-detecting means for detecting values of operating parameters of said engine, signal-generating means for determining ignition timing of said engine, based upon the detected values of said operating parameters of said engine and for generating an ignition command signal indicative of the determined ignition timing, and igniting means responsive to said ignition command signal for generating sparking voltage for discharging said at least one spark plug, said misfire-detecting system comprising:

voltage value-detecting means for detecting a value of said sparking voltage generated by said ignition means after generation of said ignition command signal; and misfire-determining means for determining a duration of a discharge of said at least one spark plug, based upon an output form said voltage value-detecting means, and for determining whether or not a misfire has occurred in said engine, based upon the determined duration of said discharge, wherein said misfire-determining means includes measuring means for measuring said duration of said discharge form a time of generation of said ignition command signal, based upon said output from said voltage value-detecting means, said measuring means for determining a reference voltage value based upon said output form said voltage value-detecting means whenever said ignition command signal is generated, for measuring a time period during which said sparking voltage subsequently detected by said voltage value-detecting means is continuously greater than the determined reference voltage value, and for adopting a measured time period as said duration of said discharge, and comparator means for comparing the measured duration of said discharge with a predetermined time period, wherein said misfire-determining means determines that a misfire has occurred in said engine, when the measured duration of said discharge is shorter than said predetermined time period, as a result of said comparison by said comparator means.

2. A misfire-detecting system as claimed in claim 1, wherein said measuring means determines said reference voltage value, based upon a peak value of said discharge voltage detected by said voltage value-detecting means.

3. A misfire-detecting system as claimed in claim 1, wherein said measuring means determines said reference voltage value, based upon an integrated value of said discharge voltage detected by said voltage value-detecting means.

4. A misfire-detecting system as claimed in any one of claims 1, 2 or 3, wherein said ignition coil comprises a primary coil and a secondary coil, said sparking voltage being primary voltage generated by said primary coil.

5. A misfire-detecting system as claimed in any one of claims 1, 2 or 3, wherein said ignition coil comprises a primary coil and a secondary coil, said sparking voltage being secondary voltage generated by said secondary coil.

6. A misfire-detecting system as claimed in any one of claim 1, 2 or 3, wherein said engine has a fuel supply system, said misfire being attributable to said fuel supply system.

7. A misfire-detecting system for detecting a misfire occurring in an internal combustion engine having an ignition system including at least one spark plug, engine operating condition-detecting means for detecting values of operating parameters of said engine, signal-generating means for determining ignition timing of said engine, based upon the detected values of said operating parameters of said engine and for generating an ignition command signal indicative of the determined ignition timing, and igniting means responsive to said ignition command signal for generating sparking voltage for discharging said at least one spark plug, said misfire-detecting system comprising:

voltage value-detecting means for detecting a value of said sparking voltage generated by said igniting means after generation of said ignition command signal; and misfire-determining means for determining a duration of a discharge of said at least one spark plug, based upon an output from said voltage value-detecting means, and for determining whether or not a misfire has occurred in said engine, based upon the determined duration of said discharge, wherein said misfire-determining means includes first comparator means operable immediately after generation of said ignition command signal, for comparing said sparking voltage detected by said voltage value-detecting means with a first predetermined voltage value, second comparator means operable when said sparking voltage exceeds said first predetermined voltage value, for comparing said sparking voltage subsequently detected by said voltage value-detecting means with a second predetermined voltage value until a predetermined time period elapses after generation of said ignition command signal, and determining means for judging that a misfire has occurred in said engine, when said sparking voltage is below said second predetermined voltage value.

8. A misfire-detecting system as claimed in claim 7, wherein said predetermined time period is set to a first time period slightly longer than a second time period from the time of generation of said ignition command signal to the time of occurrence of a capacitive discharge following an inductive discharge, said second time period being assumed when a normal firing occurs.

9. A misfire-detecting system as claimed in claim 7, wherein said first and second predetermined voltage values are set in dependence on operating conditions of said engine.

10. A misfire-detecting system as claim in any of claims 7–9, wherein said ignition coil comprises a primary coil and a secondary coil, said sparking voltage being primary voltage generated by said primary coil.

11. A misfire-detecting system as claimed in any of claims 7–9, wherein said ignition coil comprises a primary coil and a secondary coil, said sparking voltage being secondary voltage generated by said secondary coil.

12. A misfire-detecting system as claimed in any of claims 7–9, wherein said engine has a fuel supply system, said misfire being attributable to said fuel supply system.

* * * * *